US006508718B2

(12) United States Patent
Albert et al.

(10) Patent No.: US 6,508,718 B2
(45) Date of Patent: Jan. 21, 2003

(54) INSERT SHIM FOR A BOWLING BALL

(75) Inventors: David M. Albert, 8404 E. Otero Circle, Englewood, CO (US) 80112; Les Schissler, Brighton, CO (US)

(73) Assignee: David M. Albert, Littleton, CO (US)

( * ) Notice: Subject to any disclaimer, the term of this patent is extended or adjusted under 35 U.S.C. 154(b) by 0 days.

(21) Appl. No.: 09/802,814

(22) Filed: Mar. 9, 2001

(65) Prior Publication Data

US 2002/0002081 A1 Jan. 3, 2002

Related U.S. Application Data

(60) Provisional application No. 60/198,934, filed on Apr. 21, 2000, and provisional application No. 60/250,230, filed on Nov. 29, 2000.

(51) Int. Cl.[7] ..... A63B 37/00
(52) U.S. Cl. ..... 473/129; 473/130
(58) Field of Search ..... 423/125, 127, 423/128, 129, 130

(56) References Cited

U.S. PATENT DOCUMENTS 2,646,985 A * 7/1953 Nagy et al.
2,708,578 A * 5/1955 Mitchell
2,777,693 A * 1/1957 Mitchell
2,968,484 A * 1/1961 Vincent
2,979,334 A * 4/1961 Mitchell
3,078,097 A * 2/1963 Mitchell
3,113,775 A * 12/1963 Taylor
3,342,488 A * 9/1967 Novatnak
4,062,540 A 12/1977 Calentine
4,328,968 A * 5/1982 Hacker
4,621,461 A 11/1986 Martin
4,968,033 A * 11/1990 Aluotto
5,002,277 A * 3/1991 Ontko
5,261,660 A * 11/1993 Rowland
5,540,623 A * 7/1996 Symonds
5,769,730 A * 6/1998 Haskell

* cited by examiner

*Primary Examiner*—William M. Pierce
(74) *Attorney, Agent, or Firm*—Dorsey & Whitney LLP

(57) ABSTRACT

An insert shim for use in adjusting the size of a finger hole in a bowling ball, the finger hole being formed by a substantially cylindrical wall, and having a closed bottom end and an open top end, and having a standard insert positioned therein. The shim is a semi-rigid member having first and second axes, the first axis being linear and the second axis being arcuate. When inserted in the finger hole between the cylindrical insert and the cylindrical wall, the shim bending to substantially conform to the cylindrical wall of the finger hole. The shim may also be self-adhering and include adhesive means for releasably securing the shim to the cylindrical wall of the ball finger hole.

4 Claims, 3 Drawing Sheets

INSERT SHIM FOR A BOWLING BALL

CROSS-REFERENCE TO RELATED APPLICATION

This application claims the benefit of pending U.S. Provisional Application No. 60/198,934, filed Apr. 21, 2000, and U.S. Provisional Application No. 60/250,230, filed Nov. 29, 2000, which are hereby incorporated by reference in their entirety.

FIELD OF THE INVENTION

This invention relates to bowling accessories, and more specifically to insert shims for use in the gripping holes of bowling balls to adjust the size of the hole.

BACKGROUND OF THE INVENTION

Proper grip of a bowling ball is critical in accurately releasing the bowling ball during play. Many factors affect a person's grip on a bowling ball, including hand and arm strength, level of expertise in bowling, finger hole spacing, finger hole size, and the conditions of one's hand. If a person's grip is not proper, the control of the bowling ball can be adversely affected. The kind of grip a bowler desires to use also can change during time, even within the same frame. The desired grip could be affected by the remaining pin layout, and the desire to use a different ball.

One factor in a bowler's grip is the tightness of the finger holes. The finger holes typically receive the second and third fingers (middle and ring fingers, respectively). The finger holes often are lined by removable rubber inserts to make them more snug and to obtain a desired finger fit. However, the rubber inserts provide only a relatively gross adjustment of the fit, and since they are typically spongy they create a different fit given the particular force applied to the insert by the finger. The rubber inserts are typically tubular in shape and extend around the entire perimeter of the finger hole. These rubber inserts are not adjustable to respond to the physical change in size of the bowler's fingers as play progresses (e.g. due to sweat, injury, dehydration, etc.), or to allow the finger fit to be fine-tuned by smaller adjustments.

Further, some bowlers do not use rubber inserts in their finger holes yet still need to be able to adjust the fit of their finger in the finger holes.

What is missing in the art is a device that allows the fit of the finger holes to be adjusted incrementally in small amounts to provide the desired custom fit to allow the bowler to maximize control of the bowling ball.

What is missing in the art is a self-adhering device that allows the fit of the finger holes to be adjusted incrementally in small amounts to provide the desired custom fit to allow the bowler to maximize control of the bowling ball.

SUMMARY OF THE INVENTION

The present invention provides a solution to the problems described above. The insert shim of the present invention is for use in adjusting the size of a finger hole in a bowling ball, the finger hole being formed by a substantially cylindrical wall, and having a closed bottom end and an open top end, and having a standard insert positioned therein. The shim is a semi-rigid member having first and second axes, the first axis being linear and the second axis being arcuate. When inserted in the finger hole between the cylindrical insert and the cylindrical wall, the shim bends to substantially conform to the cylindrical wall of the finger hole.

In further detail, the insert shim extends around approximately the entire perimeter of the finger hole. The insert shim could also extend around approximately one-half of the perimeter of the finger hole. The insert shim could also extend around approximately one quarter of the perimeter of the finger hole. The insert shim could also extend around between one-half and the full perimeter of the finger hole. The insert shim could also extend around between one-quarter and one-half the perimeter of the finger hole. The insert shim could also extend around less than one quarter of the finger hole.

Additionally, the insert shim is resiliently biased and can have a first curvature when not inserted into the finger hole and a second curvature when inserted into the finger hole. The insert shim can also be conformable and can have a first curvature permanently converted to a second curvature when inserted in the finger hole.

Additionally, the insert shim can engage the cylindrical wall of the finger hole along its entire second axis.

Additionally, more than one insert shim can be used. For instance, the insert shim system can include a first shim being linear in a height dimension and curved in a width dimension, a second shim being linear in a height dimension and curved in a width dimension, and the first and second shims being positioned in the finger hole between the standard insert and the cylindrical wall.

Additionally, the first and second shims can be in engagement with one another. The insert shims can be aligned along their widths with one another. The insert shims can be aligned along their lengths with one another.

Additionally, the first shim can be longer than the second shim, with the first shim positioned in engagement with the cylindrical wall, and the second shim positioned between the first shim and the standard insert.

In addition to the characteristics described above, the shim can be self-adhering to the walls of the finger holes. The back surface or wall-facing surface can contain an adhesive or can be comprised of a material or materials that exhibit adhesive-like qualities and adhere to the cylindrical wall of the finger hole. A self-adhering shim can be particularly useful where the finger hole does not include a standard insert. However, the self-adhering shim could also be used in finger holes that include standard inserts.

The foregoing and other features, utilities and advantages of the invention will be apparent from the following more particular description of a preferred embodiment of the invention as illustrated in the accompanying drawings.

DETAILED DESCRIPTION OF THE PREFERRED EMBODIMENT

Figure 1:
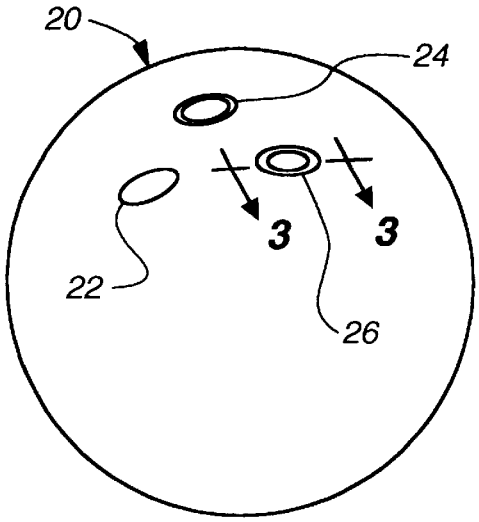
FIG. 1 is a perspective view of a bowling ball showing the finger holes and the thumb hole.

The insert shim of the present invention is shown as used in a bowling ball in FIG. 1. A bowling ball 20 is shown, and has three holes drilled therein, as is known in the art. A first hole 22 is meant for the user's thumb, a second hole 24 is meant for the user's middle finger, and a third hole 26 is meant for the user's ring finger (for a right-handed player). The user holds the ball 20 by inserting the respective thumb and fingers into the holes. The user releases the ball by extracting the thumb and fingers at the correct time during delivery.

Figure 3:
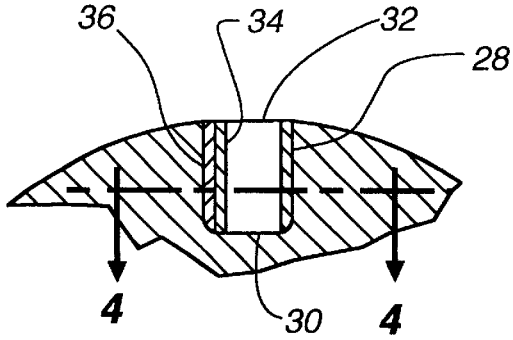
FIG. 3 is a section view taken along line 3—3 of FIG. 1.

The holes are typically drilled in the bowling ball, and thus the wall 28 of each hole is substantially cylindrical in shape with a closed bottom end 30 and an open top end 32 (See FIG. 3). The holes sometimes have chamfered top rims for comfort. The holes typically range from about 0.75 inches to about 1.5 inches in depth, and the holes typically have a diameter of approximately 0.3 to 1.0 inches in diameter. The depth and diameter of the holes can be any desired size; the ranges given above are simply examples. The holes can also be tapered, such as being conical, with an increasing or decreasing diameter; or can be oval or any other shape used for finger holes. The outline of a hole, which may vary along its depth, could be circular or any other shape. For the purposes of the description of this invention, the holes are referred to as being substantially cylindrical, while it is intended to include the different shapes described above.

Referring primarily to FIG. 3, the finger holes are generally used with a standard insert 34 made of compressible material, such as rubber. The standard insert 34 has relatively thick walls (approximately $1/8^{th}$ of an inch) and is typically cylindrical in shape to mate within the interior of the hole in which it is positioned. The standard insert 34 comes in a variety of lengths and diameters to fit a variety of sizes of finger holes. The standard insert 34 fits snugly in the finger hole, and helps create the desired snug fit of the user's finger therein. The user's finger is not held so snugly that it is difficult to extract during delivery of the bowling ball 20. The standard insert 34 provides, however, only a gross-level of size-adjustment for the user's finger. The increments between differently-sized standard inserts are not sufficient to provide a fine-tuning of the finger-hole sizing.

Figure 2:
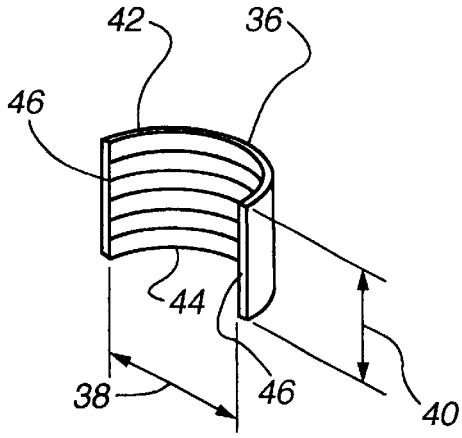
FIG. 2 is a perspective view of an insert shim of the present invention.

Referring primarily to FIG. 2, the insert shim 36 has a linear height dimension 40 (a first axis) and a curved width dimension 38 (a second axis), is very thin, and defines a top edge 42, bottom edge 44, and opposing side edges 46. Preferably, the insert shim 36 is less than approximately $1/16^{th}$ of an inch thick. The insert shim is preferably resiliently flexible across its width 38, and relatively rigid along its length 40. This rigidity is created either by the material the shim is made from, or by the curvature across the width which increases the strength (rigidity) along its length. The flexibility along its curved width 38 allows it to adjust to the particular radius of curvature of a specific finger hole when inserted therein. When removed from the finger hole, it can return to its original shape. This resiliency also assists in keeping the insert shim 36 in position when placed in the finger hole, if the insert shim is greater than a certain width (e.g. approximately more than ½ the perimeter of the finger hole). The insert shim can be held in place with an adhesive (discussed below). The shim 36 could also be linear both the width 38 and length 40 dimensions. Such a shim would simply bend in the width dimension to conform to the shape of the finger hole.

The insert shim can extend around the entire perimeter of the finger hole, or any fraction thereof. Typically, the insert shims are considered effective when extending around one-quarter to one half of the perimeter, however the amount of extension is dependent upon the user's desired result.

The rigidity along its length allows the insert shim 36 to be pushed into the finger hole between the wall of the finger hole and the outer wall of the standard insert, which can be a tight fit, requiring substantial force to be applied to slide the insert shim 36 into place. The curved shape of the insert shim helps create the particular flexibility and rigidity needed. The material that the shim is made of is also important. Plastic, metal or other such materials having strength and flexibility when in sheet form are preferred for this application. Typical sizes for the insert shim are:

| Length (inches) | Width (inches) |
|---|---|
| ½ | ¾ |
| ½ | ½ |
| 1 | ¾ |
| 1 | ½ |

Other lengths and widths are contemplated, and the length can be shortened simply by cutting off some of the top or bottom edges of the insert shim. Similarly, the width can be adjusted by simply cutting off some of the side edges of the insert shim. While preferably rectangular or square in shape, the insert shim can be a variety of shapes, including triangular, oval, hexagonal, circular, or an irregular shape as desired (such as by custom-cutting) by the user. Each of these shapes includes the unique feature of having rigidity along the insert length, and flexibility along the insert width.

Typically, the insert shim will include two axes. The first axis is parallel to the depth of the ball finger hole. The second axis is perpendicular to the depth of the ball finger hole. In a preferred embodiment, one of the axes is linear and the other axis is arcuate. The curvature of the arcuate axis may be less than, greater than, or substantially similar to the curvature of the finger hole. The arcuate axis may be biased toward a closed or open position.

Figure 4:
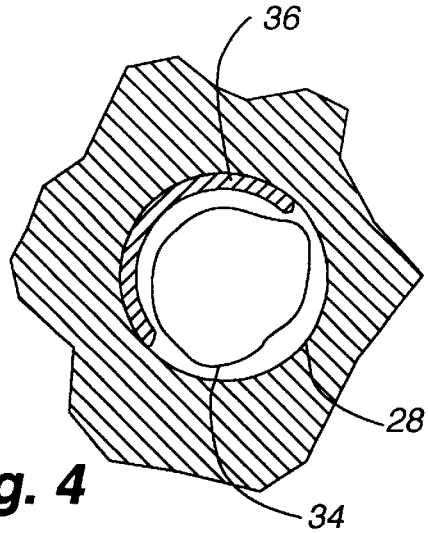
FIG. 4 is a section view taken along line 4—4 of FIG. 3.

A shown in FIGS. 3 and 4, the insert shim 36 of the present invention is positioned between the side wall of the finger hole and the standard insert 34. The insert shim is positioned in the finger hole (26, for instance) such that the curved width 38 extends around the cylindrical side wall 28 of the finger hole 26, and the linear height 40 extends along the height (or depth) of the finger hole 26. The insert shim 36 can be positioned at any location around the perimeter of the finger hole 26. Typically, however, the insert shim is positioned in the finger hole to be along the back of the user's finger. Positioning it at other positions along the perimeter will affect where the pressure is applied to the user's finger, around the finger's circumference.

The insert shim 36 can also be positioned at any location along the depth of the finger hole 26. For instance, as shown in FIG. 3, the insert shim extends along the entire length of the finger hole. The insert shim could be any length, however, and as such the top edge of the insert shim can be positioned anywhere from flush with the top end of the finger hole, to as low as it can go, with the bottom edge of the insert shim engaging the bottom wall of the finger hole. Positioning it at other positions along the length of the finger hole will affect where the pressure is applied to the user's finger, along the length of the finger. This flexibility of positioning allows for a real custom enhancement of the fit of the finger in the finger hole.

Figure 5:
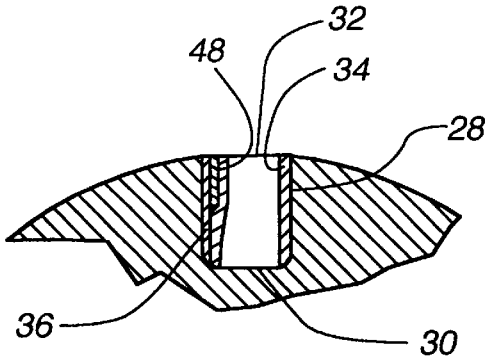
FIG. 5 is a representative section view similar to FIG. 3, showing the use of a combination of insert shims having different lengths.

The insert shim 36 can be used in combination with another insert shim 48 of the same size or of a different size. As shown in FIG. 5, a first longer insert shim is used in combination with a second shorter insert shim 48. In particular, for example, the longer insert shim 36 extends the entire length of the finger hole 26, while the shorter insert shim 48 is positioned only in the top half of the finger hole. This would create more pressure at the part of the finger adjacent the top of the finger hole than at the bottom of the finger hole. Alternatively, the shorter insert shim could be positioned along the bottom of the finger hole to put more pressure at the tip of the finger.

Figure 6:
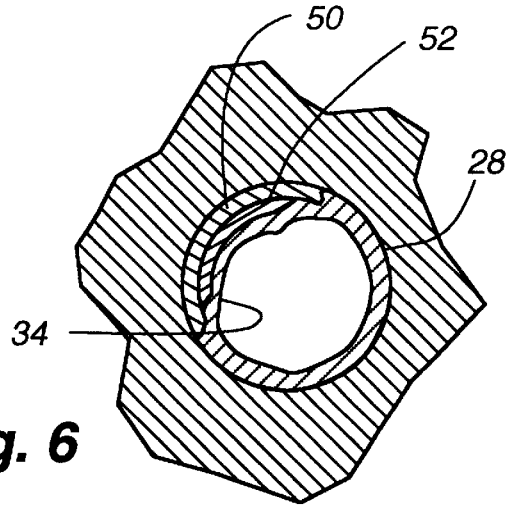
FIG. 6 is a representative section view similar to FIG. 4, showing the use of a combination of shims having different widths.

The insert shims can also be used in combinations of different widths or shapes. FIG. 6 shows one wider 50 and one narrower insert shim 52 used in combination.

When multiple shims are used in combination, the shims may be aligned in a variety of ways. For instance, the shims may be aligned along either their vertical or horizontal centerlines, or both. In addition, the shims may be aligned along any of their edges. Depending on the preference of the user, the shims may be aligned in any manner with respect to each other.

The ability to use combinations of sizes and shapes of the insert shims allows the user many options to create a custom fit as desired. The rigidity along the length and flexibility along the width allows the insert shim to be accurately positioned in the finger hole and behind the standard insert 34. These characteristics also allow the insert shim to be removed and repositioned if necessary, without any damage to the standard insert or to the insert shim. The insert shim can be removed by using one's fingernail, a tweezers, a pliers, or any other such device. Alternatively, an aperture can be formed at the top of the shim to allow an implement, such as a paper clip, to assist in removing the shim.

Figure 7A:
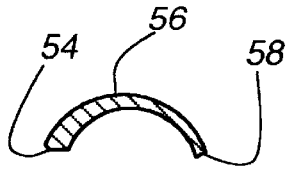
FIGS. 7*a–c* are representational section views of a variety of shim thicknesses across the width.
Figure 7B:
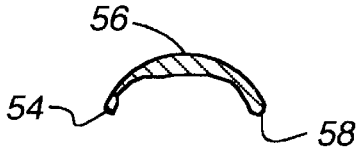
Figure 7C:
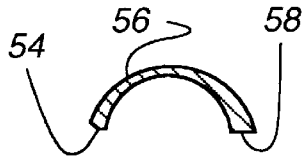
Figure 8A:
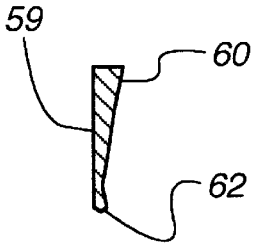
FIGS. 8*a–e* are representational section views of a variety of shim thicknesses along the length.
Figure 8B:
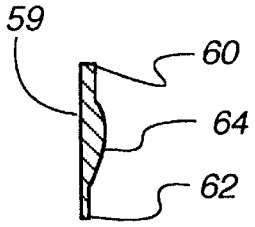
Figure 8C:
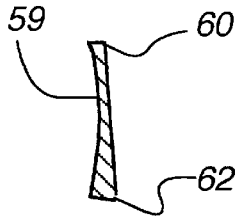
Figure 8D:
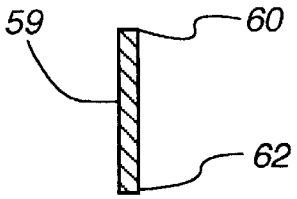
Figure 8E:
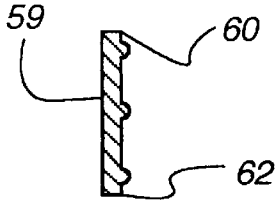

While in a preferred embodiment the insert shim has a constant thickness, it is contemplated that the thickness can vary from side to side or top to bottom. FIGS. 7*a–c* show thickness variations that are contemplated. FIG. 7*a* (top view) shows the left edge 54 of the insert shim 56 thicker than the right edge 58, with a gradual reduction in thickness from one edge to the other. FIG. 7*c* shows the opposite. FIG. 7*b* shows the left 54 and right 58 edges being thinner and the middle being thicker. Other thickness variations are contemplated, including but not limited to irregular thickness variations. FIGS. 8*a–c* show thickness variations along the length of the insert shim 59. FIG. 8*a* (top view) shows the top edge being thicker than the bottom edge. FIG. 8*c* shows the opposite. FIG. 8*b* shows the top and bottom edges being thinner and the middle 64 being thicker. FIG. 8*d* shows the preferred embodiment wherein the insert shim has a constant thickness. FIG. 8*e* shows an embodiment having multiple regions of varying thickness.

These different thicknesses can be combined if desired, and generally help the user obtain the desired and proper tightening of the finger hole.

The insert shims are easily placed into position between the standard insert and the wall of the finger hole. They are also easily removed and repositioned without damaging the insert shim, standard insert, or the finger hole. They take only a short moment to put in place or adjust, and thus can be used to customize a user's fit between deliveries, or they can be positioned and left in place for long periods of time without worry of them migrating to a different position in the finger hole. The insert traps the shim in place against the side wall of the hole.

While the insert shim is contemplated for use primarily in the finger holes of a bowling ball, it can also be used in the thumb hole if desired. To this end, a thumb hole is considered equivalent to a finger hole for the purposes of this application, including the claims.

Figure 9:
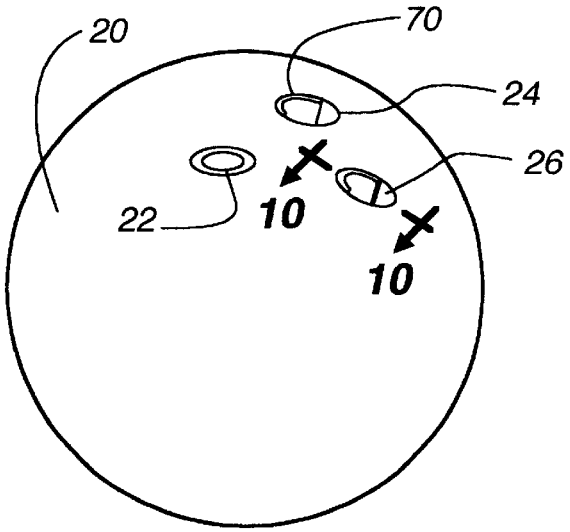
FIG. 9 is a perspective view of a bowling ball showing the finger holes and the thumb hole with two of the finger holes containing a self-adhering shim.

In another embodiment of the present invention, the insert shim is self-adhering to the side wall of the hole. The self-adhering insert shim of the present invention is shown as used in a bowling ball in FIG. 9. For this embodiment, common elements are numbered as above. A bowling ball 20 is shown, and has three holes drilled therein, as is known in the art. A first hole 22 is meant for the user's thumb, a second hole 24 is meant for the user's middle finger, and a third hole 26 is meant for the user's ring finger. The user holds the ball 20 by inserting the respective thumb and fingers into the holes. The user releases the ball by extracting the thumb and fingers at the correct time during delivery.

As described above, the finger holes are generally used with a standard insert made of compressible material, such as rubber. The standard insert fits snugly in the finger holes, and helps create the desired snug fit of the user's finger therein. The user's finger is not held so snugly that it is difficult to extract during delivery of the bowling ball 20. However, fingers holes are sometimes used without a standard insert depending on the bowler's preference. In such cases, a bowler will often still need to fine-tune the finger-hole sizing.

The self-adhering insert shim 70 of the present invention has a linear height dimension 40 (a first axis) and a curved width dimension 38 (a second axis), is very thin, and defines a top edge 42, bottom edge 44, opposing side edges 46, an adhering surface 74 in contact with the cylindrical wall 28, and a finger contacting surface 72, as shown in FIG. 3.

In one embodiment, the adhesive material of the insert shim can be exclusive of the base shim member (i.e., a separate adhesive layer applied to the base shim member). The adhering surface 74 of the shim 70 can include an adhesive material such as double sided tape or glue or can be constructed of a material that exhibits a friction or suction-like quality to at least temporarily and selectively adhere to the cylindrical wall 28 of the finger hole. A means for adhering the shim 70 that utilizes friction may also be used. If an adhesive glue is used, it is preferred that the shim 70 can be removed from the finger hole without leaving an adhesive residue on the cylindrical wall 28 of the finger hole. It is also preferred that the bond holding the shim 70 in place is strong enough to hold the shim 70 in place during use but also able to be broken to allow removal of the shim 70 by the user.

The adhesive material of the shim can be relatively thin, such as a coating, or can be relatively thick, such as a foam tape. The thicker adhesive may be desired because it could offer cushioning to some extent.

In another embodiment, the adhesive material may be integral to the base shim member. For example, materials that exhibit tacky or suction-like qualities may be used in construction of the shim 70. Both of these options would allow the shim to be made of one layer.

Figure 14A:
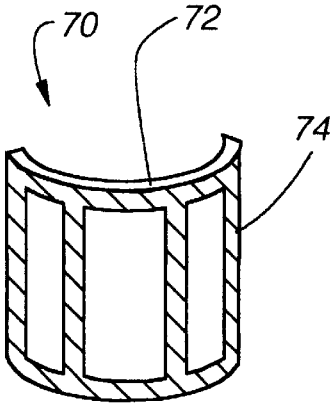
FIGS. 14*a–c* are back views of the self-adhering shim with varying adhesive patterns.
Figure 14B:
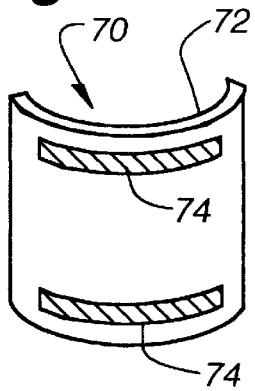
Figure 14C:
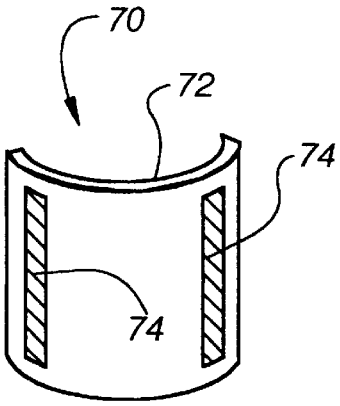
Figure 15:
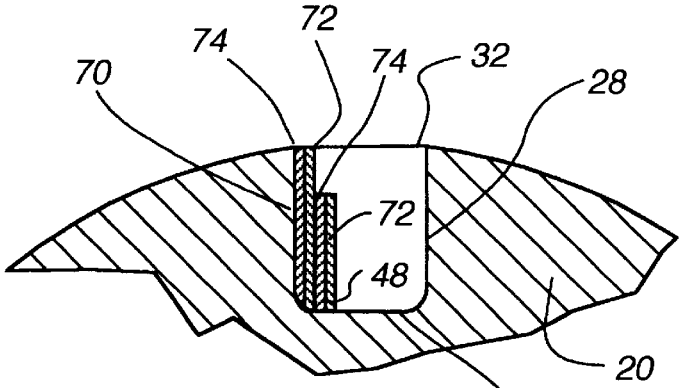
FIG. 15 is a section view of a finger hole containing two-layered self-adhering shims.

As shown in FIGS. 14*a–c*, various adhesive patterns 74 may be utilized to secure the shim 70 to the cylindrical wall 28 of a finger hole. The adhesive material can be applied to the entire convex side, or in strips along its top and bottom (FIG. 14*b*), spaced vertically along its length (FIGS. 14*a*, and 14*c*) or could be applied in any configuration that allows the shim to be securely attached to the inner wall of the bowling ball.

The self-adhering insert shim can extend around the entire perimeter of the finger hole, or any fraction thereof. Typically, the self-adhering insert shims are considered effective when extending around one-quarter to one half of the perimeter, however the amount of extension is dependent upon the user's desired result. If the insert shim extends more than half-way around the entire perimeter of the finger hole, adhesive materials may be unnecessary. If the insert shim is bent or curved such that it is biased to extend to a position that has a larger diameter than the inside of the respective finger hole, the force of the insert shim against the wall of the hole may effectively adhere the insert shim to the wall of the finger hole thereby reducing or eliminating the need for other adhering means.

Preferably, the self-adhering insert shim 70 also includes substantially the same dimensions and the same material characteristics as the non-self-adhering embodiment described above.

Figure 10:
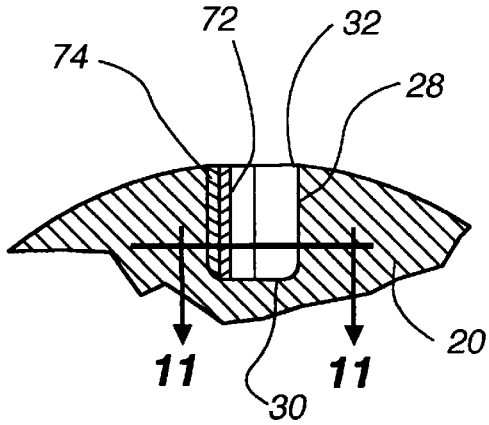
FIG. 10 is a section view taken along line 10—10 of FIG. 9.
Figure 11:
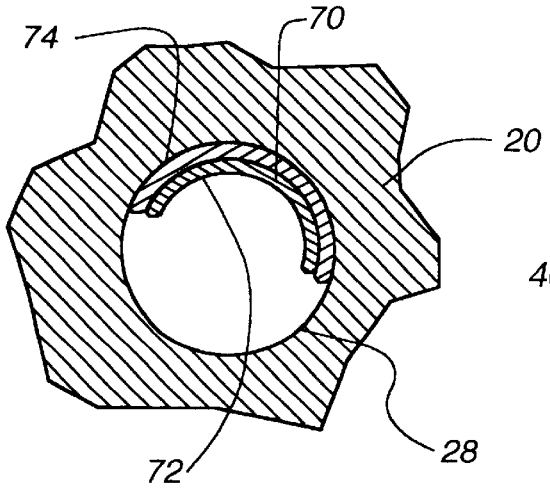
FIG. 11 is a section view taken along line 11—11 of FIG. 10.
Figure 12:
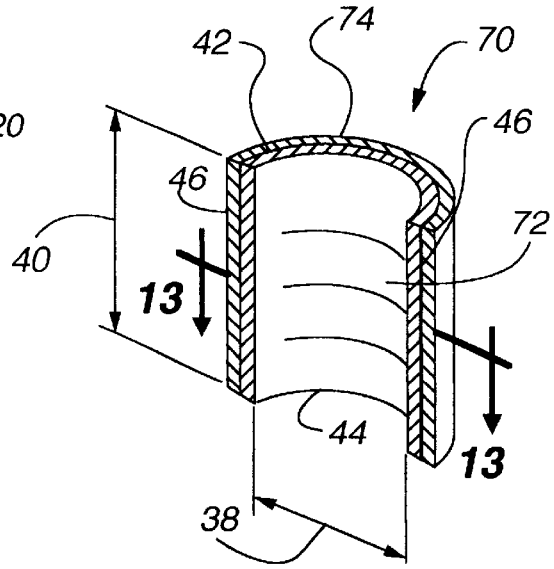
FIG. 12 is a perspective view of a self-adhering insert shim of the present invention.
Figure 13:
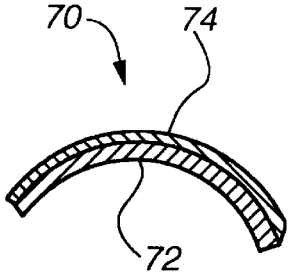
FIG. 13 is a section view taken along line 13—13 of FIG. 12 and shows a self-adhering shim thickness across the width.

A shown in FIGS. 10 and 11, the self-adhering insert shim 70 of the present invention is positioned to adhere to the side wall of the finger hole. The self-adhering insert shim is positioned in the finger hole (26, for instance) such that the curved width 38 extends around the cylindrical side wall 28 of the finger hole 26, and the linear height 40 extends along the height (or depth) of the finger hole 26. The adhering surface 74 of the shim 70 is releasably secured to the side wall 28 of the finger hole 26. The finger contacting surface 72 of the shim 70 faces the interior of the finger hole 26. The finger contacting surface 72 does not include any adhesive properties to ensure that the user can easily remove their finger from the finger hole 26.

As in the non-self-adhering embodiment above, the self-adhering insert shim 70 can be positioned at any location around the perimeter of the finger hole 26 and at any location along the depth of the finger hole 26.

With respect to combining the self-adhering insert shim 70 with other shims of similar or different sizes, widths, or shapes, the self-adhering insert shim 70 can be combined the same as the non-self-adhering embodiment described above.

As discussed above, the ability to use combinations of sizes and shapes of the self-adhering insert shims 70 allows the user many options to create a custom fit as desired. The rigidity along the length and flexibility along the width allows the self-adhering insert shim 70 to be accurately positioned in the finger hole. These characteristics also allow the self-adhering insert shim 70 to be removed and repositioned if necessary, without any damage to the self-adhering insert shim 70.

While in a preferred embodiment the self-adhering insert shim 70 has a constant thickness, it is contemplated that the thickness can vary from side to side or top to bottom. Regular and irregular thickness variations are also possible. These different thicknesses can be combined if desired, and generally help the user obtain the desired and proper tightening of the finger hole 26.

The self-adhering insert shims 70 are easily placed into position against the wall of the finger hole 26. They are also easily removed and repositioned without damaging either the self-adhering insert shim 70 or the finger hole 26. They take only a short moment to put in place or adjust, and thus can be used to customize a user's fit between deliveries, or they can be positioned and left in place for long periods of time without worry of them migrating to a different position in the finger hole 26. Ideally shims 70 do not lose their adhesive qualities, but they might upon removal from the finger hole 26.

While the self-adhering insert shim 70 is contemplated for use primarily in the finger holes of a bowling ball, it can also be used in the thumb hole if desired.

Preferred embodiments of the insert shim can be manufactured using standard window blind slats made of either metal or plastic. The blind slats are cut into a plurality of sections. The length of the sections is typically the depth of the bowling ball finger hole. While the individual shims can be produced by cutting single blind slats, a large quantity of slats can be cut at the same time by utilizing industrial cutting means well known in the art. Cutting a large quantity of slats at the same time will increase the quantity of shims that can be produced in a given time and reduce the cost of producing the shims overall. It is conceivable that the shims could be produce by other methods such as injection molding, die-cast molding, and other means well known in the arts of plastic and metal manufacturing.

In the self-adhering embodiment, it is preferred that adhesive means are applied to the surface of the slat prior to cutting. However, in certain applications it is conceivable that the adhesive means could be applied after cutting the slat.

A presently preferred embodiment of the present invention and many of its improvements have been described with a degree of particularity. It should be understood that this description has been made by way of example, and that the invention is defined by the scope of the following claims.

I claim:

1. An apparatus for adjusting the size of a finger hole in a bowling ball, the finger hole being defined by a wall, and having a closed bottom end and an open top end, the apparatus comprising:

a standard insert positioned in the finger hole;

a shim member positioned in the finger hole between said standard insert and the wall, said shim member having a first and second axes, the first axis being linear; and when positioned in the finger hole between said standard insert and the wall, said shim member bending along said second axis to substantially conform to the wall of the finger hole while the first axis remains linear;

wherein said shim member may be removed from and reinserted in the finger hole between said standard insert and the wall.

2. The apparatus in claim 1, wherein:

said second axis is arcuate.

3. An apparatus for adjusting the size of a finger hole in a bowling bowl, the finger hole being defined by a wall, and having a closed bottom end and an open top end, the apparatus comprising:

a standard insert positioned in the finger hole;

a shim member positioned in the finger hole between said standard insert and the wall, said shim member having a first and second axes and having a front surface and a rear surface, one of said axes being linear and the other axis being arcuate; and when positioned in the finger hole between said standard insert and the wall, said shim member bending to substantially conform to the wall of the finger hole with the rear surface adjacent to the wall, and said rear surface includes adhesive to removably adhere said shim member to said wall;

wherein said shim member may be removed from and reinserted in the finger hole between said standard insert and the wall.

4. A method of adjusting the size of a finger hole in a bowling ball, the finger hole being defined by a wall, and having a closed bottom end and an open top end, comprising:

placing a standard insert in the finger hole;

positioning a shim member in the finger hole between said standard insert and the wall, said shim member having a first and second axes, said first axis being linear; and bending said shim member along said second axis to substantially conform to the wall of the finger hole while said first axis remains linear.

* * * * *